US007059926B2

(12) United States Patent
McMurray et al.

(10) Patent No.: US 7,059,926 B2
(45) Date of Patent: Jun. 13, 2006

(54) METHOD OF MAKING A SPARK PLUG HAVING A MULTI-TIERED CENTER WIRE ASSEMBLY

(75) Inventors: Mark S McMurray, Toledo, OH (US); Lawrence W Geer, Waterville, OH (US); Thomas R Nohl, Holland, OH (US)

(73) Assignee: Federal Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/297,298

(22) Filed: Dec. 8, 2005

(65) Prior Publication Data

US 2006/0099872 A1 May 11, 2006

Related U.S. Application Data

(62) Division of application No. 10/701,890, filed on Nov. 5, 2003, now Pat. No. 7,019,448.

(51) Int. Cl.
*H01T 21/02* (2006.01)
*H01T 13/20* (2006.01)

(52) U.S. Cl. ..... 445/7; 313/141; 313/118; 313/135; 123/169 EL

(58) Field of Classification Search ..... 445/7
See application file for complete search history.

(56) References Cited

U.S. PATENT DOCUMENTS

| | | | | |
|---|---|---|---|---|
| 2,449,403 | A | 9/1948 | McDougal | 174/152 S |
| 2,459,286 | A | 1/1949 | Rabezzana et al. | 313/11.5 |
| 2,902,617 | A | 9/1959 | Cole | 313/144 |
| 2,906,909 | A | 9/1959 | Somers et al. | 313/145 |
| 3,683,232 | A | 8/1972 | Baur | 315/58 |
| 3,915,721 | A | 10/1975 | Kamigaito et al. | 252/520.1 |
| 4,112,330 | A | 9/1978 | Stimson et al. | 315/46 |
| 4,144,474 | A | 3/1979 | Nishio et al. | 315/53 |
| 4,345,179 | A | 8/1982 | Asai et al. | 313/136 |
| 4,427,915 | A | 1/1984 | Nishio et al. | 313/141 |
| 4,504,411 | A | 3/1985 | Sakai et al. | 252/506 |
| 4,713,582 | A | 12/1987 | Yamada et al. | 313/58 |
| 4,949,006 | A | 8/1990 | Oshima et al. | 313/144 |
| 5,008,584 | A | 4/1991 | Atsumi et al. | 313/136 |
| 5,283,499 | A | 2/1994 | Adam et al. | 313/135 |
| 6,160,342 | A | 12/2000 | Nishikawa et al. | 313/141 |
| 6,191,525 | B1 | 2/2001 | Tanaka et al. | 313/141 |

FOREIGN PATENT DOCUMENTS

GB 2 016 593 A 9/1979

*Primary Examiner*—Karabi Guharay
*Assistant Examiner*—Sikha Roy
(74) *Attorney, Agent, or Firm*—Dickinson Wright PLLC

(57) ABSTRACT

A method of making an ignition device and center wire assembly that includes first, second and third electrode members, a conductive seal, and a noise suppressing seal. The method locates the first electrode member at an axial end of the center wire assembly near a spark gap and the third electrode member at an axial end of the center wire assembly such that it receives an electrical ignition pulse and a second electrode member between the first and third electrode members. Furthermore, the method locates the conductive seal between the first and second electrode members and the noise suppressing seal between the second and third electrode members.

23 Claims, 1 Drawing Sheet

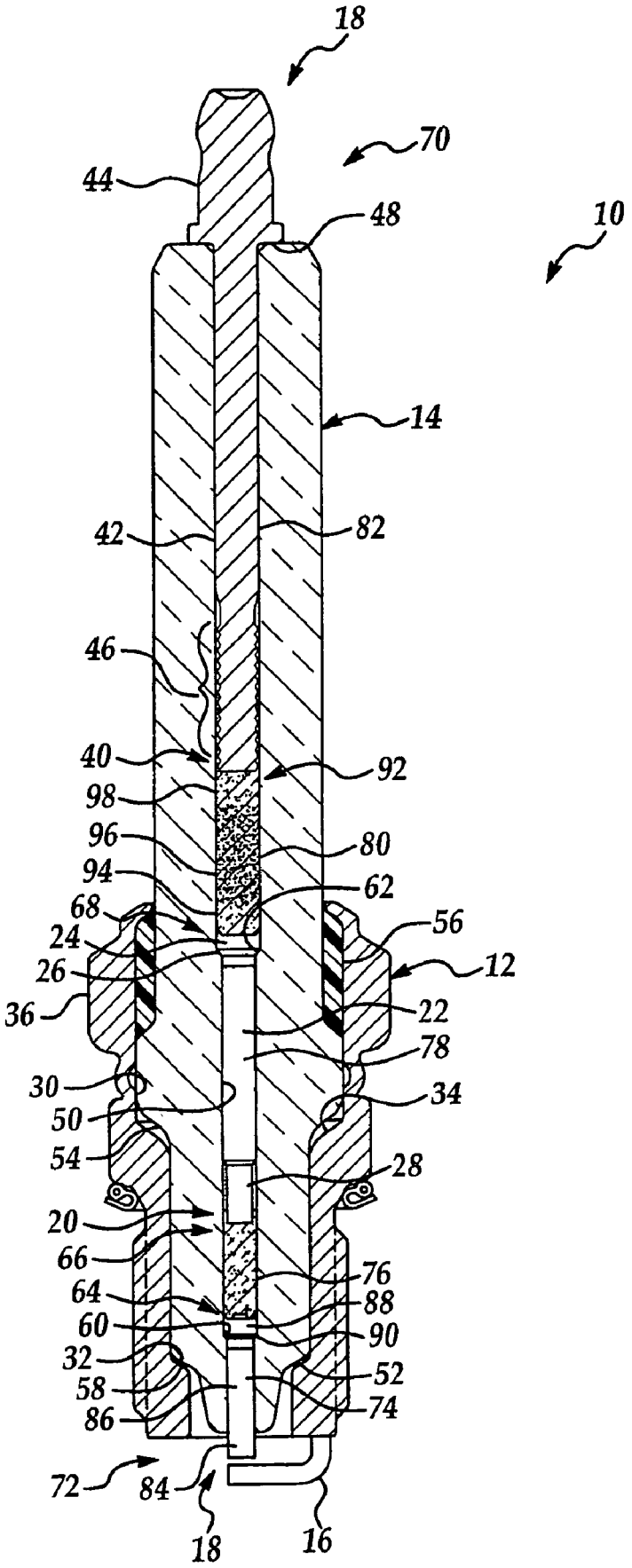
18
70
44
48
10
14
42
82
46
40
92
98
96
80
94
62
68
56
24
12
26
36
22
78
30
34
50
54
28
20
66
76
64
88
60
90
32
52
58
74
86
72
84
18
16

METHOD OF MAKING A SPARK PLUG HAVING A MULTI-TIERED CENTER WIRE ASSEMBLY

CROSS-REFERENCES TO RELATED APPLICATIONS

This patent application is a divisional of and claims priority to U.S. patent application Ser. No. 10/701,890, filed Nov. 5, 2003 now U.S. Pat. No. 7,019,448 which is incorporated herein by reference in its entirety.

The present invention relates generally to ignition devices such as spark plugs and igniters, and, more particularly, to ignition devices having center wire assemblies that utilize glass seals.

BACKGROUND OF THE INVENTION

Spark plugs and other such ignition devices used in internal combustion engines are subjected to high temperature environments produced in the combustion chambers. The high temperature environment often takes a toll on the different components of the spark plug and, over time, can cause diminished performance of the spark plug. One way in which the spark plug performance is negatively affected involves the conductance of the center wire assembly, whose components are used to deliver an electrical ignition pulse from the plug's terminal input to its spark gap. Corrosion, breakdown of materials and other phenomena accelerated by the extreme heat can negatively affect the conductive characteristics of these components, thus altering the intensity of the ignition pulse and ultimately the spark delivered to the combustion chamber. This effect can be of particular concern in spark plugs that utilize resistive noise suppression to reduce EMI (electromagnetic interference) from the plug.

The use of resistive noise suppression devices is well known in spark plugs. One type of these noise suppressors is commonly referred to as a capsule resistor. An older example of the use of capsule resistors can be seen in U.S. Pat. No. 2,906,909 issued to Somers et al. The spark plug shown in this patent includes a center wire assembly having (starting from the spark gap and moving axially upwards towards the ignition lead receptacle) a center electrode, a conductive glass seal, a metal contact, a capsule resistor element, a contact spring and a threaded contact cap. The conductive glass seal is a fired in conductive seal (FICS) that provides a gas tight seal while permitting the discharge energy to be conducted through the glass seal.

Another known type of spark plug noise suppressor is a resistive glass seal that is often used in addition to or in lieu of a conductive glass seal to provide both the gas tight seal within the insulator center bore as well as a resistive path for the spark discharge energy to reduce electrical interference. This resistive glass seal is a fired in suppressive seal (FISS) and can provide the benefits of both the conductive glass seal and capsule resistor in a single component. But as with most components, with advantages come certain drawbacks. In certain high temperature environments, such as natural gas engines or Formula One engines where temperatures in the center wire assembly can exceed 700° F., a noise suppressing glass seal can exhibit an electrical resistance that increases over time as a result of the elevated operating temperatures, and can even reach a point at which the seal behaves as an open circuit.

Thus, it would be advantageous to provide an improved center wire assembly for use in a spark plug that permits the use of a noise suppressing glass seal in a manner that provides some protection of the glass seal from the high heat environment of the combustion chamber.

SUMMARY OF THE INVENTION

The above-noted shortcomings of prior art suppressive seal center wire assemblies are overcome by the present invention which provides an ignition device and center wire assembly that includes first, second, and third electrode members, a conductive seal, and a noise suppressing seal. The first electrode member is located at an axial end of the center wire assembly near a spark gap, the third electrode member is located at an axial end of the center wire assembly such that it receives an electrical ignition pulse, and the second electrode member is axially located between the first and third electrode members. Furthermore, the conductive seal is axially located between the first and second electrode members, and the noise suppressing seal is axially located between the second and third electrode members. The center wire assembly can be used in a spark plug, igniter, or other such ignition device which will typically include an insulator holding the center wire assembly along with a metal shell fit over at least a portion of the insulator.

Preferably, the center wire assembly includes as its three electrode members a firing electrode, intermediate electrode, and terminal electrode. The conductive seal can be a FICS such as a conductive glass seal. The noise suppressing seal can be a FISS such as a resistive glass seal. By locating the conductive seal farther up towards the terminal end of the ignition device, it is isolated to some extent from the heat of the engine via the lower conductive glass seal.

The present invention also provides a method of manufacturing a center wire assembly for use in a spark plug. The method includes the following steps, although not necessarily in this particular order: inserting a firing electrode into a longitudinal bore of an insulator; inserting conductive glass powder into the longitudinal bore above the firing electrode; inserting an intermediate electrode into the longitudinal bore such that the glass powder is located between the firing and intermediate electrodes in contact with both said electrodes; firing said conductive glass powder to thereby form a conductive seal between the firing and intermediate electrodes; inserting resistive glass powder into the longitudinal bore above the intermediate electrode; inserting a terminal electrode into the longitudinal bore such that the resistive glass powder is located between the intermediate and terminal electrodes and is in contact with both the intermediate and terminal electrodes; and firing said resistive glass powder to thereby form a noise suppressing seal between the intermediate and terminal electrodes. Preferably, the method is carried out with separate firing steps being used for both the conductive glass and resistive glass powders to form the two seals during two separate steps.

BRIEF DESCRIPTION OF THE DRAWINGS

The advantages and features of the spark plug center wire assembly of the present invention will be readily apparent with reference to the appended description, claims and drawing, which is a partial cutaway view of a preferred embodiment of a spark plug and center wire assembly of the present invention.

DETAILED DESCRIPTION OF THE PREFERRED EMBODIMENT

The spark plug and center wire assembly discussed below and illustrated in the appended drawings are generally designed for use in an internal combustion engine, and are designed to distance a noise suppressing seal from the heat generated at or near a spark gap. By locating a firing electrode, a conductive seal and an intermediate electrode between the noise suppressing seal and the spark gap, the center wire assembly is able to utilize the noise suppression attributes of the suppressive seal, while distancing that seal from the high temperatures created during the combustion process. Although particular embodiments of the various spark plug components such as material compositions, are discussed in the following description, it should be recognized that they are only provided for exemplary purposes and could be exchanged with appropriate substitutes known in the art.

Referring now to the Figure, there is shown a spark plug 10 for use in an internal combustion engine, such as a standard car engine or a high performance (e.g., Formula One) engine. An ignition device incorporating the invention can be used for other types of internal combustion engines, including natural gas and turbine engines. Spark plug 10 generally includes a shell 12, insulator 14, ground electrode 16 and center wire assembly 18. As is commonly known in the art, shell 12 is a cylindrical, metallic component having a hollow longitudinal bore 30 extending along its entire axial length. According to this embodiment, the interior diameter of longitudinal bore 30 is non-uniform, such that interior shoulders 32 and 34 are formed at boundaries between bore sections having different interior diameters. Shoulders 32 and 34 are interior, circumferential edges designed to support complimentarily shaped shoulder sections of insulator 14. Shell 12 also has an installation feature 36, such as a hex, formed on its exterior surface. This feature allows one to easily install spark plug 10 into a cylinder head, or wherever else it is to be employed. The shape and size of the shell may vary greatly according to the particular application, but is designed to firmly receive insulator 14, which will now be discussed.

Like the shell, insulator 14 is also a generally cylindrical component having an elongated longitudinal bore 50 extending centrally through its entire axial length. As its name suggests, insulator 14 is made from generally non-electrically conductive materials and is intended to electrically isolate the center wire assembly from the conductive shell 12 and other components in the surrounding environment. The exterior surface of the insulator is designed to fit within longitudinal bore 30 of the shell component. Insulator 14 includes a pair of exterior shoulders 52 and 54, at least one of which is sized to fit and rest upon interior shoulders 32 and 34, respectively, thus prohibiting the insulator from axial movement in the downward direction. Sealing components, such as cylindrical sealing component 56 or the ring-shaped sealing component 58, can be utilized to provide additional sealing between the exterior of the insulator and the interior of the shell. As with the shell's bore 30, the insulator center bore 50 also has a pair of interior shoulders 60 and 62. These shoulders are intended to support complimentarily shaped shoulders of the center wire assembly 18, and can be located at various axial positions within center bore 50.

The ground electrode 16 is an "L-shaped" metallic component that is mechanically and electrically connected to the lowermost axial end of shell 12. The ground electrode can be welded, brazed, or attached to the shell by some other method known in the art. Ground electrode 16 is located near the lowermost axial end of the center wire assembly such that a spark gap is formed. It should be noted, the ground electrode can be of a different shape and can include precious metal inserts for decreasing corrosion and wear, to name but a few of the modifications from that shown. In this regard, the manufacture and assembly of the metallic shell 12, insulator 14, and ground electrode 16 can all be (but need not be) done conventionally.

The center wire assembly 18 is an assembly of conductive components that transmit a high voltage electrical ignition pulse from a terminal end 70 to a firing end 72, at which point the pulse arcs across the spark gap to initiate the combustion process. Center wire assembly 18 includes (beginning from firing end 72 and extending up towards terminal end 70) a firing electrode 74, a conductive seal 76, an intermediate electrode 78, a noise suppressing seal 80, and a terminal electrode 82. The firing electrode 74 is a metallic electrode protruding from the lower axial end of insulator 14 such that it forms a spark gap with ground electrode 16, as is commonly known in the art. The composition of the firing electrode largely depends on the particular application for which it is used. For instance, in applications where it is desirable to transfer heat up through the center wire assembly and away from the spark gap, a copper-cored nickel electrode could be used, as is well known in the art. In applications requiring a small diameter firing electrode, a copper-core cannot be accommodated, thus, a solid nickel electrode could be used. In the preferred embodiment, the firing electrode includes a firing tip 84, a shank portion 86 and an enlarged head section 88. The firing tip 84 is the lowermost section of the firing electrode and can include a precious metal insert, such as platinum (Pt), iridium (Ir), palladium (Pd), or alloys of any of these, for additional protection against corrosion and pitting. It is from this firing tip that the high voltage ignition pulse arcs across the spark gap to the nearby ground electrode 16. Moving axially upwards from the firing tip 84 is the shank portion 86, which is an elongated section connecting firing tip 84 to the enlarged head section 88. The enlarged head section has a greater diameter than the adjoining shank portion, thus, an exterior shoulder 90 exists which rests upon the interior shoulder 60 of the insulator. The uppermost surface of the enlarged head section is designed to contact conductive seal 76, and may designed according to any of a number of different conformations, including being flat, concave, convex, or having slots or a central protrusion to promote good contact and bonding with the conductive seal 76.

The conductive seal 76 is an electrically conductive seal designed to couple the firing electrode 74 at a lower axial end 64 to the intermediate electrode 78 at an upper axial end 66. Preferably, the conductive seal is formed from a metallic glass powder fit, such as a copper/glass powder, that is fused together by melting the powder at an elevated temperature. The metallic powder is first inserted into center bore 50, is then tamped to a desired compression, and is eventually fired, as will be explained subsequently in greater detail. This type of conductive seal is commonly known in the art, and is sometimes referred to as a fired in conductive seal (FICS). The axial length of this seal varies depending on the particular design of the spark plug, however, it should be noted that certain difficulties in compressing the conductive seal can arise when the axial length exceeds a certain amount. Once the conductive seal is in place, intermediate electrode 78 is inserted into center bore 50 such that it contacts the upper axial end 66 of the conductive seal.

Intermediate electrode 78 is a metallic electrode having a shape similar to firing electrode 74, and includes a lower axial end 20, a shank portion 22 and an enlarged head section 24. Like the firing electrode, the intermediate electrode can be comprised of numerous materials, depending on the particular application for which it is used. The lower axial end 20 can either be a flat or otherwise contoured surface, and can be used to compress the glass material of conductive seal 76 during the manufacturing process. Also, at the lower axial end 20, the shank 22 can have a reduced diameter portion 28 as shown to permit a certain amount of the glass of conductive seal 76 to flow up and around the electrode during firing of the conductive seal. Shank portion 22 is a generally elongated section that extends from lower axial end 20 to the enlarged head section 24. Once again, the enlarged head section has a greater diameter than the adjoining shank portion, thus, an exterior shoulder 26 is formed which rests upon the interior shoulder 62 of the insulator. The uppermost surface of the enlarged head section is designed to contact the noise suppressing seal 80, and can be formed in a like manner to the uppermost portion of firing electrode 74 with any of a number of different shaped surface configurations.

Noise suppressing seal 80 is an electrically conductive, noise suppressing seal designed to couple the intermediate electrode 78 at a lower axial end 68 to the terminal electrode 82 at an upper axial end 92. Preferably, the noise suppressing seal is comprised of three powder sections having known resistive characteristics that are designed to minimize the amount of noise emitted from the spark plug, as is well known in the art. The first powder section 94 is comprised of a conductive glass powder, such as that used in conductive seal 76 and already discussed. The second powder section 96 includes a resistive powder material, preferably a carbon-based glass fit, having known resistive characteristics. The third powder section 98 can be formed from the same or a different conductive glass powder than is used for the first powder section. The powdered glass used to form suppressive seal 80 is first inserted into center bore 50 on top of the intermediate electrode, then tamped with a predetermined amount of force, and eventually fired to melt and fuse the powder and firmly secure the seal in place. This type of noise suppressing seal is sometimes referred to as a fired in suppressor seal (FISS). Furthermore, the axial length of this seal can vary depending on the particular spark plug design employed and the noise suppression sought. It is worth noting, the particular three-section FISS shown here is but one example of a suitable noise suppressing seal that may be used. Other noise suppressing seals having more, less, or different sections could also be used, as the main purpose of this component is to provide noise suppression. In this regard, inductive and other types of suppressive materials could be used in lieu of resistive-type suppression.

The terminal electrode 82 is an elongated metallic component having a terminal post for receiving an ignition lead such that it may conduct a high voltage ignition pulse to the adjoining noise suppressing seal. As with the other electrode components, the terminal electrode can be comprised of numerous materials depending on its particular application. However, a 10/18 steel alloy is often preferred. The particular terminal electrode shown here includes a lower axial end 40, an elongated shank portion 42 and a terminal post 44. The lower axial end 40 has a slightly smaller diameter than the adjoining shank portion 42, such that a small gap is formed between the outer surface of the terminal electrode and the inner surface of the center bore 50. Surface features 46, such as ribs, threads, dimples, etc., are formed on the outer surface of the terminal electrode in the area of this gap. Intermediate electrode 78 can be provided with such surface features as well. During the firing process, the terminal electrode 82 is forced against the molten suppressive seal such that a certain amount of the molten seal is squeezed upwards into this gap between the terminal electrode and insulator. The suppressive seal material bonds with the terminal electrode, and the surface features 46 provide an improved bonding surface. This same approach can be used for the intermediate electrode into suppressive seal 80 and by one or both of the intermediate and firing electrodes into conductive seal 76. Farther up shank portion 42 the terminal post 44 has an enlarged diameter and is shaped to receive an electrical boot of the ignition lead (not shown). The transition between the shank portion and the terminal post forms a shoulder 48, which rests upon the uppermost axial end of the insulator such that the terminal electrode is prevented from moving further into the center bore. The terminal post can be shaped according to one of numerous designs depending on the particular ignition lead and application.

The manufacturing method of the present invention primarily addresses the process for assembling the center wire assembly 18, thus, the following description will be mainly focused on that portion of the overall spark plug assembly. According to a preferred embodiment, the method of assembling spark plug 10 generally involves the following steps: insulator 14 is formed with its central bore 50; the center wire assembly 18 is manufactured starting at the firing end with electrode 74, conductive seal 76, and intermediate electrode 78 and ending at the terminal end with suppressive seal 80 and terminal electrode 82; followed by installation of the insulator 14 and its center wire assembly 18 into the metal shell 12 which will have previously been formed with its ground electrode 16.

The insulator 14 along with its stepped center bore 50 can be made using conventional techniques that are well known to those skilled in the art. Similarly, the three electrodes 74, 78, and 82 are each manufactured prior to assembly using conventional techniques. In forming the center wire assembly 18, the firing electrode 74 is first inserted into the center bore 50 from its upper axial end such that enlarged head section 88 contacts and rests upon interior insulator shoulder 60. This arrangement fixes the firing tip 84 at a predetermined axial location relative to the insulator body. Once the firing electrode is in place, the glass powder for conductive seal 76 is added to the center bore. The glass powder may be added all at once or in successive shots. If added all at once, a tamping tool, such as a long rod, could be used to tamp the conductive seal one or more times. If added in successive shots, the conductive seal could be tamped in between each shot of powder. Either way, the conductive seal is preferably tamped with a predetermined amount of force such that a desired compression of the powder is achieved. In some applications, it may be preferable to omit the tamping process altogether. Once this is complete, the intermediate electrode 78 is inserted into the center bore 50 such that it contacts the uppermost portion of the glass powder.

Because the conductive seal is yet to be fired and melted, it occupies more volume than it does after the firing process. Thus, at this point the enlarged head section 24 of the intermediate electrode typically will not contact interior shoulder 62. Once the intermediate electrode is in place, it is loaded with a certain amount of pressure in the downward axial direction and the entire assembly undergoes a firing (heating) process. As the conductive seal is being fired, preferably at a temperature between 1500°–1700° F., the seal begins to melt and settle within the bore. This allows the intermediate electrode, which is under a certain amount of downward force, to compress the melting powder until enlarged head section 24 comes to rest on interior shoulder 62. As the conductive seal sets, it firmly bonds and attaches to the intermediate and firing electrodes.

The noise suppressing seal 80 is produced in much the same was as conductive seal 76. The resistive glass powder used to form suppressive seal 80 is first inserted into center bore 50 from the upper axial end of the insulator, next it is tamped with a predetermined amount of force, and eventually it is fired. Again, the glass powder may be inserted in a single shot or in multiple shots having tamping steps in between each. As shown in the illustrated embodiment, the seal 80 can be formed with a resistive glass section sandwiched between two sections of conductive glass. For this construction, a first charge of conductive glass powder can be inserted and tamped, followed by a charge of resistive glass powder which is then tamped, and then by another charge of conductive glass powder which is also tamped down. Following this, terminal electrode 82 is added to the center bore 50. As before, the volume taken by the compressed powdered glass prevents the terminal electrode from being completely pushed down into the center bore. With shoulder 48 located slightly above the uppermost axial end of the insulator, the entire insulator and center wire assembly is again passed through an oven to melt the glass powder and form the conductive seal 80. The terminal electrode is loaded with a predetermined amount of downwards axial force, such that as the glass powder begins to melt the terminal electrode is forced further downwards until shoulder 48 sits squarely on the insulator. Concurrently, the molten suppressive seal 80 being compressed by further downward movement of the terminal electrode is squeezed up into the gap located between the terminal electrode and the bore 50 such that the seal bonds with surface features 46. Any of a number of known glass powders can be used for these seals 76 and 80, and the resistive or other noise suppressive characteristics of the seals can be selected as desired or needed for a particular application using known mixes and percentages of additives to the powders.

Once the center wire assembly 18 has been completed, the insulator is then ready to be attached to the metal shell 12. The shell is first provided with ground electrode 16 already attached to its lower axial end by means of welding, brazing or any other suitable form of attachment. Alternatively, the ground electrode could be attached at a later point in the assembly of the spark plug. The insulator 14 is placed into the shell's longitudinal bore 30 from the upper axial end such that exterior insulator shoulders 52 and 54 contact and rest upon interior shell shoulders 32 and 34, respectively. It is worth noting that various types of sealing components, such as ring seal 58, could be placed in between the shoulders of the shell and those of the insulator to increase the sealing bond between the two components. Once the insulator is in place, sealing component 56 is added in the space between the outer surface of the insulator and the inner surface of longitudinal bore 30. Next, the uppermost circumferential edge of the shell is bent or otherwise mechanically deformed radially inwards such that it contacts the insulator, thereby firmly affixing the shell to the insulator and retaining the sealing component 56 in place.

It will thus be apparent that there has been provided in accordance with the present invention a spark plug center wire assembly and a method for manufacturing the same that achieves the aims and advantages specified herein. It will, of course, be understood that the foregoing description is of a preferred exemplary embodiment of the invention and that the invention is not limited to the specific embodiment shown. For instance, the ignition device and center wire assembly concepts discussed herein could be employed in automotive, aircraft, and other internal combustion engine applications not mentioned herein. Accordingly, all modifications required for such applications would be apparent to those skilled in the art. One such modification would involve the terminal electrode. In most aircraft igniter applications, the terminal post 44 could be substituted with a terminal electrode, or contact, that remains internally within the center bore 50. In this design, the ignition lead, acting as a male component, would also be inserted into the center bore such that it is mechanically and electrically coupled to the terminal electrode, acting as a female component. This configuration could be used instead of the design shown in the Figure where the ignition lead includes a boot that fits over top of the terminal post, thus remaining outside of the center bore. Also, the particular steps and order discussed in connection with the aforementioned assembly process could vary. For example, the glass powder used to form conductive seal 76 need not be fired prior to that of suppressive seal 80; rather, the glass powders can be added and compressed and a single firing used to melt and form both seals. Alternatively, the intermediate and terminal electrodes could be heated and brought into contact with the conductive and noise suppressing seals, respectively, in order to fire the seals. Other changes and modifications, in addition to those previously mentioned, will become apparent to those skilled in the art and all such changes and modifications are intended to be within the scope of the present invention.

What is claimed is:

1. A method of manufacturing a center wire assembly for use in a spark plug, comprising the steps of:

(a) inserting a firing electrode into a longitudinal bore of an insulator;

(b) inserting a conductive glass powder into the longitudinal bore above the firing electrode;

(c) inserting an intermediate electrode into the longitudinal bore such that the conductive glass powder is located between the firing and intermediate electrodes in contact with both said electrodes;

(d) fusing the conductive glass powder together to thereby form a conductive seal between the firing and intermediate electrodes;

(e) inserting a resistive glass powder into the longitudinal bore above the intermediate electrode;

(f) inserting a terminal electrode into the longitudinal bore such that the resistive glass powder is located between the intermediate and terminal electrodes; and (g) fusing the resistive glass powder together to thereby form a noise suppressing seal between the intermediate and terminal electrodes.

2. The method of claim 1, wherein step (d) comprises heating the insulator and center wire assembly to fuse the conductive glass powder into said conductive glass seal.

3. The method of claim 2, wherein step (d) comprises applying a predetermined axial pressure upon the intermediate electrode during heating of the insulator and center wire assembly.

4. The method of claim 2, wherein step (d) comprises applying a predetermined axial pressure upon the terminal electrode during heating of the insulator and center wire assembly.

5. The method of claim 1, wherein step (g) comprises heating the insulator and center wire assembly to fuse the resistive glass powder into said conductive glass seal.

6. The method of claim 1, wherein steps (d) and (g) are carried out as two separate heating operations.

7. The method of claim 1, wherein step (e) further comprises inserting a first amount of conductive glass powder prior to the resistive glass powder and inserting a second amount of conductive glass powder after the resistive glass powder, and wherein step (g) further comprises fusing the first and second amounts of conductive glass powder along with the resistive glass powder.

8. The method of claim 1, wherein step (b) comprises adding at least one shot of the conductive glass powder followed by tamping to compress the powder.

9. The method of claim 8, wherein tamping is performed using a predetermined amount of force to achieve a predetermined compression of the powder.

10. The method of claim 1, wherein step (f) comprises adding at least one shot of the resistive glass powder followed by tamping to compress the powder.

11. The method of claim 10, wherein tamping is performed using a predetermined amount of force to achieve a predetermined compression of the powder.

12. A method of manufacturing a spark plug, comprising the steps of:

(a) inserting a firing electrode into a longitudinal bore of an insulator;

(b) inserting a conductive glass powder into the longitudinal bore above the firing electrode;

(c) inserting an intermediate electrode into the longitudinal bore such that the conductive glass powder is located between the firing and intermediate electrodes in contact with both said electrodes;

(d) fusing the conductive glass powder together to thereby form a conductive seal between the firing and intermediate electrodes;

(e) inserting a resistive glass powder into the longitudinal bore above the intermediate electrode;

(f) inserting a terminal electrode into the longitudinal bore such that the resistive glass powder is located between the intermediate and terminal electrodes;

(g) fusing the resistive glass powder together to thereby form a noise suppressing seal between the intermediate and terminal electrodes;

(h) inserting the insulator into a metal shell having a bore which is adapted to receive the insulator; and (i) sealing the insulator within the bore.

13. The method of claim 12, wherein step (d) comprises heating the insulator and center wire assembly to fuse the conductive glass powder into said conductive glass seal.

14. The method of claim 13, wherein step (d) comprises applying a predetermined axial pressure upon the intermediate electrode during heating of the insulator and center wire assembly.

15. The method of claim 13, wherein step (d) comprises applying a predetermined axial pressure upon the terminal electrode during heating of the insulator and center wire assembly.

16. The method of claim 12, wherein step (g) comprises heating the insulator and center wire assembly to fuse the resistive glass powder into said conductive glass seal.

17. The method of claim 12, wherein steps (d) and (g) are carried out as two separate heating operations.

18. The method of claim 12, wherein step (e) further comprises inserting a first amount of conductive glass powder prior to the resistive glass powder and inserting a second amount of conductive glass powder after the resistive glass powder, and wherein step (g) further comprises fusing the first and second amounts of conductive glass powder along with the resistive glass powder.

19. The method of claim 12, wherein step (b) comprises adding at least one shot of the conductive glass powder followed by tamping to compress the powder.

20. The method of claim 19, wherein tamping is performed using a predetermined amount of force to achieve a predetermined compression of the powder.

21. The method of claim 12, wherein step (f) comprises adding at least one shot of the resistive glass powder followed by tamping to compress the powder.

22. The method of claim 21, wherein tamping is performed using a predetermined amount of force to achieve a predetermined compression of the powder.

23. The method of claim 12, wherein sealing comprises insertion of a sealing component in a space between an outer surface of the insulator and an inner surface of the bore and mechanically deforming an uppermost circumferential edge of the shell radially inwardly to retain the sealing component and affix the shell to the insulator.

* * * * *